US008960464B2

(12) United States Patent
Peckham

(10) Patent No.: US 8,960,464 B2
(45) Date of Patent: Feb. 24, 2015

(54) COUPLER SUPPORT MECHANISM

(75) Inventor: Jason D. Peckham, Taylors, SC (US)

(73) Assignee: Wabtec Holding Corp., Wilmerding, PA (US)

( * ) Notice: Subject to any disclaimer, the term of this patent is extended or adjusted under 35 U.S.C. 154(b) by 281 days.

(21) Appl. No.: 13/438,210

(22) Filed: Apr. 3, 2012

(65) Prior Publication Data

US 2012/0255926 A1 Oct. 11, 2012

Related U.S. Application Data

(60) Provisional application No. 61/473,353, filed on Apr. 8, 2011.

(51) Int. Cl.
*B61G 9/02* (2006.01)
*B61G 7/12* (2006.01)

(52) U.S. Cl.
CPC ..... *B61G 7/12* (2013.01)
USPC ..... 213/9

(58) Field of Classification Search
CPC ..... B61G 9/00; B61G 9/04; B61G 9/06; B61G 9/14; B61G 9/20; B61G 9/22
USPC ..... 213/7, 9, 12, 14, 18, 40 R, 44, 46 A
See application file for complete search history.

(56) References Cited

U.S. PATENT DOCUMENTS

| | | | |
|---|---|---|---|
| 325,923 | A | 9/1885 | Ferguson |
| 346,881 | A | 8/1886 | Zeigler |
| 472,328 | A | 5/1890 | Johnson |
| 1,344,780 | A | 6/1920 | Van Dorn |
| 1,468,057 | A | 9/1923 | Walker |
| 2,183,990 | A | 10/1937 | Dunn |
| 2,150,330 | A | 6/1939 | Kurtossy |
| 2,161,724 | A | 6/1939 | Scharfenberg |
| 2,246,406 | A | 6/1941 | Wittmer |
| 2,276,167 | A | 3/1942 | Dalton |
| 2,380,303 | A | 7/1945 | Geiger |
| 2,451,551 | A | 10/1948 | Haseltine |
| 2,504,253 | A | 4/1950 | Dath |
| 2,639,821 | A | 5/1953 | Danielson |
| 2,825,473 | A | 3/1958 | Metzger |
| 2,897,982 | A | 8/1959 | Larsson |

(Continued)

FOREIGN PATENT DOCUMENTS

| | | |
|---|---|---|
| AT | 202184 | 2/1959 |
| AT | 250430 B | 11/1966 |

(Continued)

*Primary Examiner* — R. J. McCarry, Jr.
(74) *Attorney, Agent, or Firm* — The Webb Law Firm

(57) ABSTRACT

A coupler for transit cars includes a coupler anchor, a coupler mechanism supported to the coupler anchor by a deformation tube and draft gear element, and a coupler support mechanism. The coupler support mechanism includes two support arms pivotally mounted to a lower part of a coupling connector. A tension rod is provided for each support arm to control the pivotal displacement of each support arm. Each support arm further includes a torsion spring which is loaded as the support arm is pivotally displaced in an upward direction and unloaded as the support arm is pivotally displaced in a downward direction. The position of each support arm may be adjusted independently, thereby allowing adjustment of the coupler along longitudinal and lateral planes of the transit car.

20 Claims, 14 Drawing Sheets

(56) References Cited

U.S. PATENT DOCUMENTS

| | | | | |
|---|---|---|---|---|
| 2,994,442 | A | | 8/1961 | Frederick |
| 3,152,699 | A | | 10/1964 | Vickerman |
| 3,211,298 | A | | 10/1965 | Hindin et al. |
| 3,536,314 | A | | 10/1970 | Tonne et al. |
| 3,655,066 | A | | 4/1972 | Metzger |
| 3,710,951 | A | * | 1/1973 | Cope ..... 213/15 |
| 3,715,139 | A | | 2/1973 | Tuggle |
| 3,741,406 | A | | 6/1973 | Anderson |
| 4,311,244 | A | | 1/1982 | Hindin et al. |
| 4,627,545 | A | | 12/1986 | Herbert et al. |
| 4,927,035 | A | | 5/1990 | Geng et al. |
| 5,139,161 | A | | 8/1992 | Long |
| 5,344,542 | A | | 9/1994 | Maher et al. |
| 5,503,280 | A | | 4/1996 | Hanano et al. |
| 5,509,548 | A | | 4/1996 | Kreher |
| 5,954,211 | A | | 9/1999 | Grau et al. |
| 6,390,314 | B1 | | 5/2002 | Pinlam et al. |
| 7,175,036 | B2 | | 2/2007 | Sommerfeld et al. |
| 7,467,724 | B2 | | 12/2008 | Voong et al. |
| 7,708,157 | B2 | | 5/2010 | Kemper |
| 8,297,419 | B2 | | 10/2012 | Gansweidt |
| 2005/0145591 | A1 | | 7/2005 | Mattschull et al. |
| 2007/0084818 | A1 | | 4/2007 | Brabb et al. |

FOREIGN PATENT DOCUMENTS

| | | | |
|---|---|---|---|
| AT | 307493 | B | 4/1973 |
| AT | 375316 | B | 7/1984 |
| CA | 1229324 | A | 11/1987 |
| CH | 395172 | A | 7/1965 |
| CN | 2880620 | Y | 3/2007 |
| DE | 1017201 | B | 10/1957 |
| DE | 1021409 | B | 12/1957 |
| DE | 1530196 | A1 | 5/1970 |
| DE | 20120581 | U1 | 6/2003 |
| EP | 0583604 | A1 | 2/1994 |
| EP | 1447297 | A1 | 8/2004 |
| GB | 876173 | | 8/1961 |
| GB | 924143 | | 4/1963 |
| GB | 952058 | | 3/1964 |
| GB | 1296047 | | 11/1972 |
| GB | 1360248 | | 7/1974 |
| GB | 1393310 | | 5/1975 |
| JP | 958468 | A | 3/1997 |

* cited by examiner

COUPLER SUPPORT MECHANISM

CROSS REFERENCE TO RELATED APPLICATIONS

This application claims priority from U.S. Provisional Patent Application No. 61/473,353, filed Apr. 8, 2011, which is incorporated herein by reference.

BACKGROUND OF THE INVENTION

1. Field of the Invention

The present invention is directed to couplers for transit cars, and more particularly, to couplers having a coupler support mechanism for multi-dimensional adjustment for a coupler head of a mass transit car.

2. Description of Related Art

Vertical support mechanisms are commonly used in mass transit car connectors known as couplers. The purpose of existing vertical support mechanisms is to support a transit car coupler as well as to provide vertical adjustment of the coupler. Conventional vertical support mechanisms utilize spring-suspended members capable of compressing under vertical load imposed by the coupler. In a typical application, vertical load imposed by the coupler is transferred to the vertical support mechanism such that one or more springs are compressed. The number and stiffness of the springs determines the vertical displacement of the vertical support mechanism under load.

In another design, spring-suspended members may be replaced with a hydraulic mechanism where the vertical load imposed by the coupler is borne by a force transferred to a hydraulic fluid inside a cylinder. In another alternative, springs in the spring-suspended member may be replaced with a resilient elastomeric material, such as rubber, capable of deflecting under load and restoring its shape once the load is removed.

Existing designs for vertical support mechanisms are associated with a number of disadvantages. Conventional vertical support mechanisms only adjust the position of the coupler in a single plane in a vertical direction. Lateral adjustment of the coupler is not possible because these vertical support mechanisms allow motion only in the vertical direction parallel to the ground. Additionally, because large springs or hydraulic cylinders are required for sustaining heavy vertical loads imposed on the coupler, conventional vertical support mechanisms take up a substantial amount of space. Such arrangements prevent the installation of auxiliary components adjacent to the coupler. Furthermore, existing designs are susceptible to a reduction in operating efficiency due to contamination formed due to debris buildup between one or more coils of the springs. Additionally, conventional vertical support mechanisms always support a load imposed by the coupler and cannot be disengaged from supporting the load without removing the vertical support mechanism from the coupler.

SUMMARY OF THE INVENTION

In view of the foregoing, a need exists for a coupler support mechanism capable of multi-dimensional adjustment such that alignment of couplers between adjacent transit cars can be adjusted in more than one plane of motion. An additional need exists for providing a coupler support mechanism having compact dimensions and reduced weight which allow the installation of auxiliary components adjacent to the coupler. A further need exists for providing a coupler support mechanism that reduces the possibility of contamination from debris buildup that reduces the operating efficiency of the coupler support mechanism. An additional need exists for a coupler support mechanism that can be disengaged from supporting a load imposed by the coupler without removing the coupler support mechanism from the coupler.

According to one embodiment, a coupler for a railway car may include a coupler anchor, a coupler mechanism connected to the coupler anchor, and a coupler support mechanism supporting the coupler mechanism. The coupler support mechanism may include a plurality of support arms connected to the coupler anchor for supporting a railway car coupler. In addition, the coupler support mechanism may also include a plurality of torsion springs corresponding to the plurality of support arms. The plurality of torsion springs may be operatively connected to the plurality of support arms such that pivotal movement of any of the plurality of support arms causes a rotational movement of the corresponding torsion springs. Each of the plurality of support arms may be pivotally movable independent of the remaining support arms to allow for movement of the coupler anchor in at least two planes of motion.

In accordance with another embodiment, the coupler for a railway car may further include a plurality of tension rods corresponding to the plurality of support arms. The plurality of tension rods may be operatively connected to the support arms to control the pivotal movement of the support arms. A first end of each of the plurality of tension rods may be connected to the coupler anchor and a second end of each of the plurality of tension rods may be connected to the corresponding support arm. The length of each of the plurality of tension rods may be adjustable such that each of the corresponding torsion springs is loaded when the tension rod is shortened and unloaded when the tension rod is lengthened. In this embodiment, the length of each of the plurality of tension rods may be adjustable by rotating an upper end of the tension rod with respect to the lower end of the tension rod.

According to yet another embodiment, each of the plurality of support arms of the coupler support mechanism may include a support arm mounting element having a recessed central portion and an opening extending through the support arm mounting element. In this embodiment, each of the plurality of support arms may further include an arm element extending from the mounting element. The corresponding tension rod may be operatively connected to the arm element. A first end of each torsion spring may be connected to the corresponding support arm and a second end of each torsion spring may be connected to a torsion spring connector.

According to another embodiment, a railway car coupler for coupling railway cars may include a coupler anchor connected to a railway car body, a coupler mechanism connected to the coupler anchor by a deformation tube, and a coupler support mechanism supporting the coupler mechanism. The coupler support mechanism may include a plurality of support arms connected to the coupler anchor for supporting the railway car coupler. Additionally, the coupler support mechanism may also include a plurality of support arms connected to the coupler anchor for supporting a railway car coupler and a plurality of torsion springs corresponding to the plurality of support arms. In this embodiment, the plurality of torsion springs may be operatively connected to the plurality of support arms such that pivotal movement of any of the plurality of support arms causes a rotational movement of the corresponding torsion springs.

According to a further embodiment, each of the plurality of support arms may be pivotally movable independent of the remaining support arms to allow for movement of the coupler anchor in at least two planes of motion. The railway car coupler may further include a plurality of tension rods corresponding to the plurality of support arms. The plurality of tension rods may be operatively connected to the support arms to control the pivotal movement of the support arms. A first end of each of the plurality of tension rods may be connected to the coupler anchor and a second end of each of the plurality of tension rods may be connected to the corresponding support arm.

According to yet another embodiment, the length of each of the plurality of tension rods may be adjustable such that each of the corresponding torsion springs is loaded when the tension rod is shortened and unloaded when the tension rod is lengthened. The length of each of the plurality of tension rods may be adjustable by rotating an upper end of the tension rod with respect to the lower end of the tension rod. In this embodiment, each of the plurality of support arms may include a support arm mounting element having a recessed central portion and an opening extending through the support arm mounting element. Additionally, each of the plurality of support arms may further include an arm element extending from the mounting element.

The foregoing and other features and characteristics as well as the methods of operation will become clear upon consideration of the following description with reference to the accompanying drawings, wherein like reference numerals designate corresponding parts in the various figures.

DESCRIPTION OF THE PREFERRED EMBODIMENTS

Figure 1:
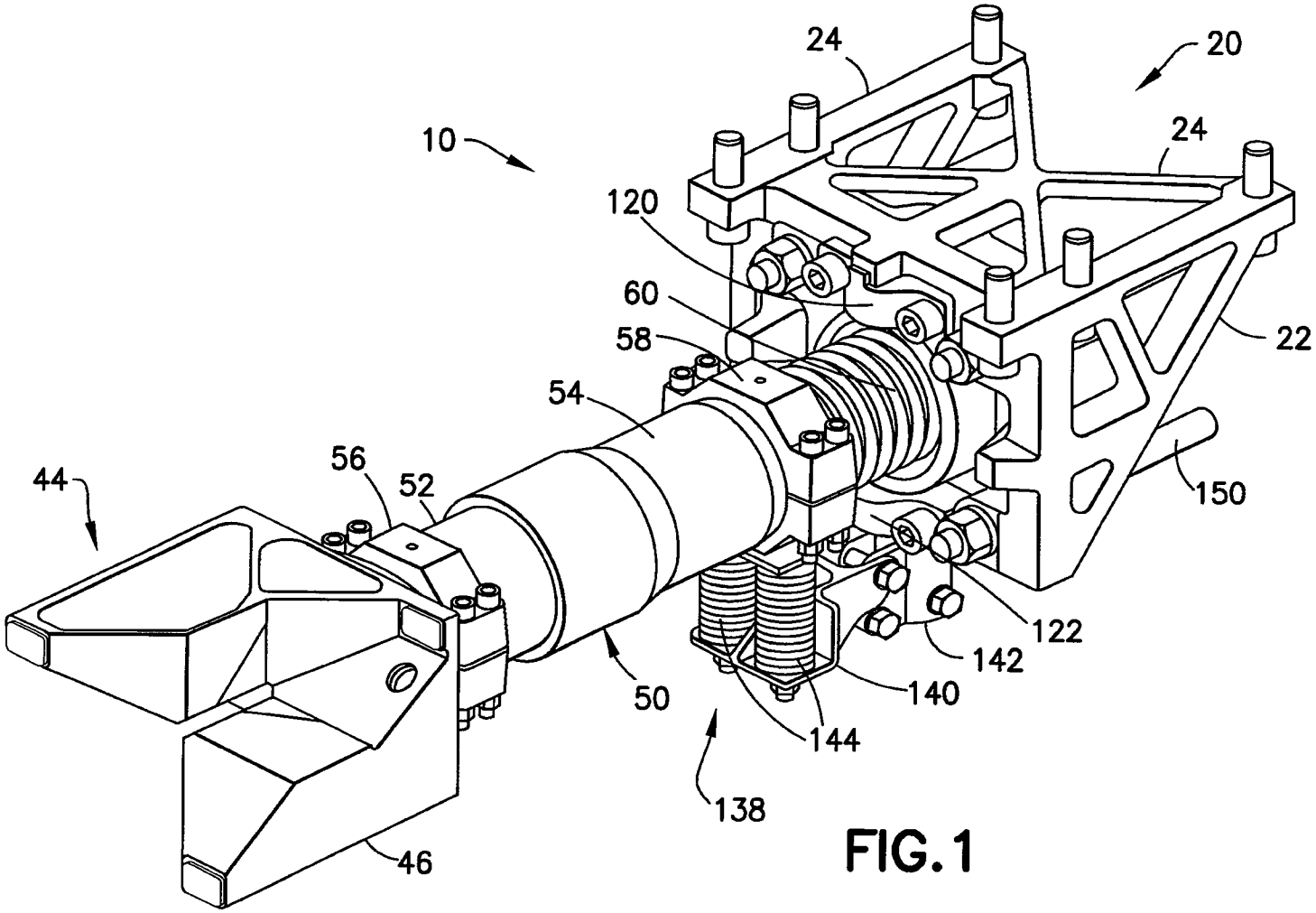
FIG. 1 PRIOR ART
FIG. 1 is a perspective view of a typical vertical support mechanism installed on a transit car coupler.

For purposes of the description hereafter, spatial and directional terms shall relate to the invention as it is oriented in the drawing figures. However, it is to be understood that the invention may assume various alternative variations, except where expressly specified to the contrary. It is also to be understood that the specific components illustrated in the attached drawings, and described in the following specification, are simply exemplary embodiments of the invention. Hence any reference to specific dimensions and other physical characteristics related to the embodiments disclosed herein is not to be considered as limiting.

Referring to the drawings in which like reference characters refer to like parts throughout the several views thereof, the present invention is generally described in terms of a coupler having a coupler support mechanism operative for providing multi-dimensional adjustment to alignment of a coupler head of a transit car.

Referring initially to FIG. 1, an embodiment of a coupler 10 is shown. Coupler 10 as described herein is intended for connection to a car frame (not shown) of a transit car (not shown), as will be readily apparent to those skilled in the rail vehicle art. Coupler 10 is desirable for use in mass transit vehicles and like transit cars used for passenger mass transit. However, this use is intended to be non-limiting and coupler 10 has applications in transit cars generally. Coupler 10 in the depicted embodiment generally includes a coupler anchor 20, a coupler mechanism 44, an energy-absorbing deformation tube 50, and an energy absorbing draft gear mechanism 60. Deformation tube 50 connects coupler mechanism 44 to coupler anchor 20 by connection with draft gear mechanism 60. Coupler 10 further includes one or more energy absorbing devices 150 used to support draft gear mechanism 60 to coupler anchor 20.

Coupler anchor 20 has a box-shaped anchor body 22 of generally square or rectangular shape that is truncated, as viewed from its lateral sides, so that the side profile of anchor body 22 is generally triangular. Anchor body 22 is formed by a series of interconnected structural elements 24. A front face of anchor body 22 defines a front opening and interfaces with a slide anchor assembly 112 which secures draft gear mechanism 60 to anchor body 22 desirably in an interior area of anchor body 22. An upper face of anchor body 22 may define several apertures which accept securing elements for interfacing with and securing anchor body 22 to the car frame of a transit car.

Briefly, coupler mechanism 44 includes a coupler head 46 for mating coupler head 46 with a receiving coupler head 46 on an adjacent transit car. Coupler mechanism 44 is coupled to coupler anchor 20 by energy absorbing deformation tube 50, as indicated previously. Deformation tube 50 has a distal end 52 and a proximal end 54. Distal end 52 of deformation tube 50 is secured to coupler head 46 of coupler mechanism 44 by a first coupling connector 56. Proximal end 54 of deformation tube 50 is secured to draft gear mechanism 60 by a second coupling connector 58.

As noted previously, supporting slide anchor assembly 112 is used to support draft gear mechanism 60 to anchor body 22 of coupler anchor 20, and generally within a front opening of anchor body 22. Draft gear mechanism 60 is secured to slide anchor assembly 112 by an upper clamp element 120 and a lower clamp element 122.

With continuing reference to FIG. 1, coupler 10 is illustrated showing a vertical support mechanism 138. Vertical support mechanism 138 in this embodiment is utilized for supporting second coupling connector 58 and supporting a vertical load imposed on coupler 10. In the embodiment shown in FIG. 1, vertical support mechanism 138 is supported by lower cross leg and/or lower clamp element 122 of slide anchor assembly 112. Vertical support mechanism 138 includes a single or multi-spring support element 140 which vertically supports second coupling connector 58 from underneath. One or more springs 144 are disposed between second coupling connector 58 and spring support element 140. Spring support element 140 may be pivotally supported to a second support element 142 by a suitable mechanical fastener such as a pin or a bolt and nut combination. Second support element 142 may be supported to one or both of the lower cross leg and lower clamp element 122 again by a suitable mechanical fastener, such as a pin or a bolt and nut combination. An additional mechanical fastener of suitable design may be provided to extend through the second support element 142 to limit the downward pivotal movement of spring support element 140.

Vertical support mechanism 138 illustrated in FIG. 1 is operative for providing support for coupler 10 along the vertical axis direction. Any vertical load imposed on coupler mechanism 44 during the coupling of transit cars or motion of the transit car is transferred directly to vertical support mechanism 138. Vertical loading of coupler mechanism 44 causes springs 144 to compress which, in turn, causes spring support element 140 to pivot with respect to second support element 142. The resulting vertical movement of coupler 10 is determined by the stiffness of springs 144.

In the prior art embodiment shown in FIG. 1, coupler mechanism 44 is adjustable in a vertical direction. Lateral adjustment of coupler mechanism 44 prevented because mechanical fasteners prevent any rotation with respect to the longitudinal axis of the transit car. Additionally, because large springs 144 are required for sustaining heavy vertical loads, vertical support mechanism 138 takes up a substantial amount of space around coupler 10. In the embodiment shown in FIG. 1, vertical support mechanism 138 extends in a downward direction underneath second coupling connector 58. This arrangement prevents the installation of auxiliary components on coupler 10 in proximity to second coupling connector 58 or coupler anchor 20. Coupler 10 having vertical support mechanism 138 is described in greater detail in U.S. Patent Application No. 61/439,607, filed on Feb. 4, 2011 and entitled "Energy Absorbing Coupler", the entirety of which is incorporated herein by reference.

Figure 3:
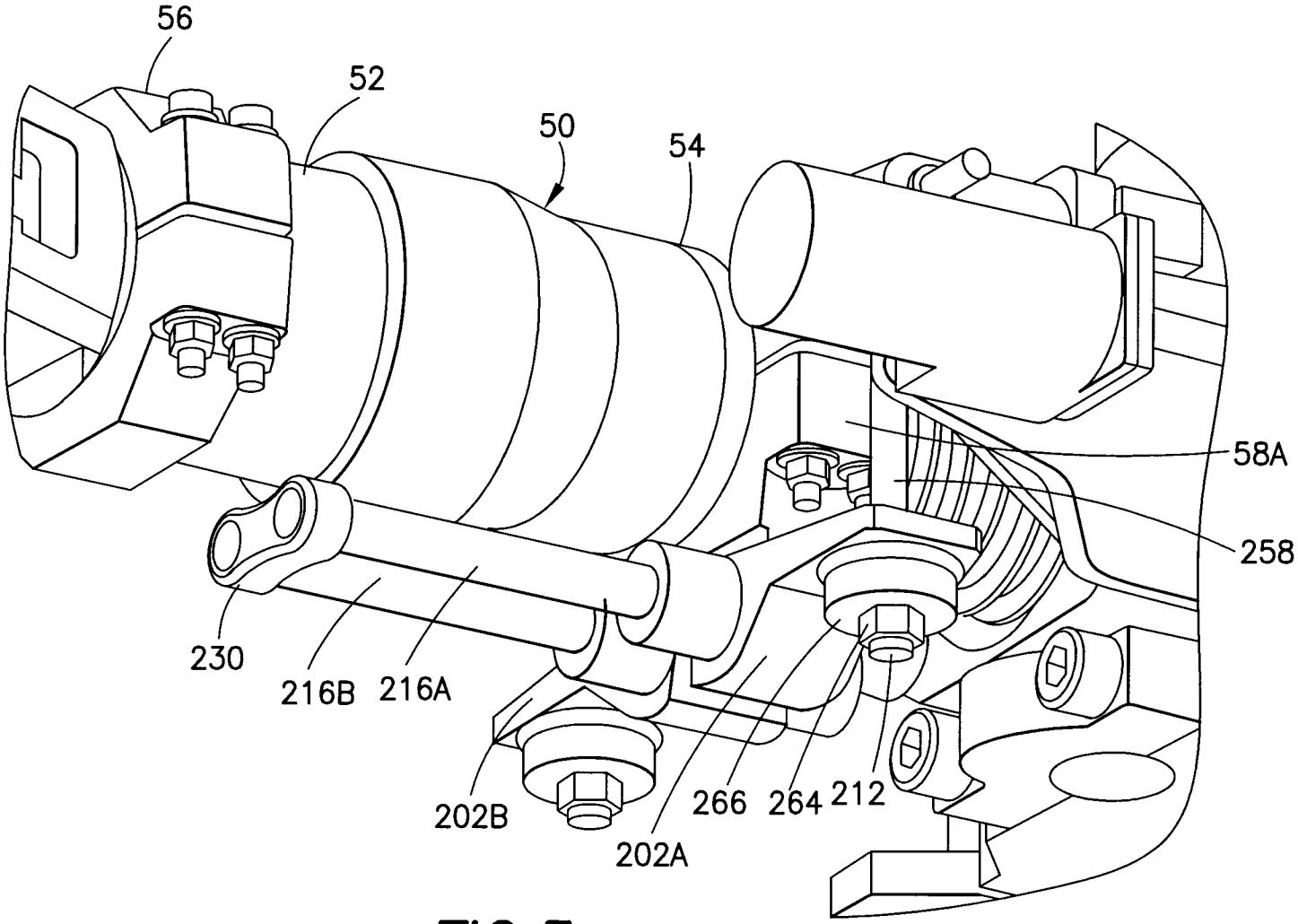
FIG. 3 is a bottom perspective view of the coupler support mechanism installed on a transit car coupler according to the embodiment shown in FIG. 2.
Figure 4:
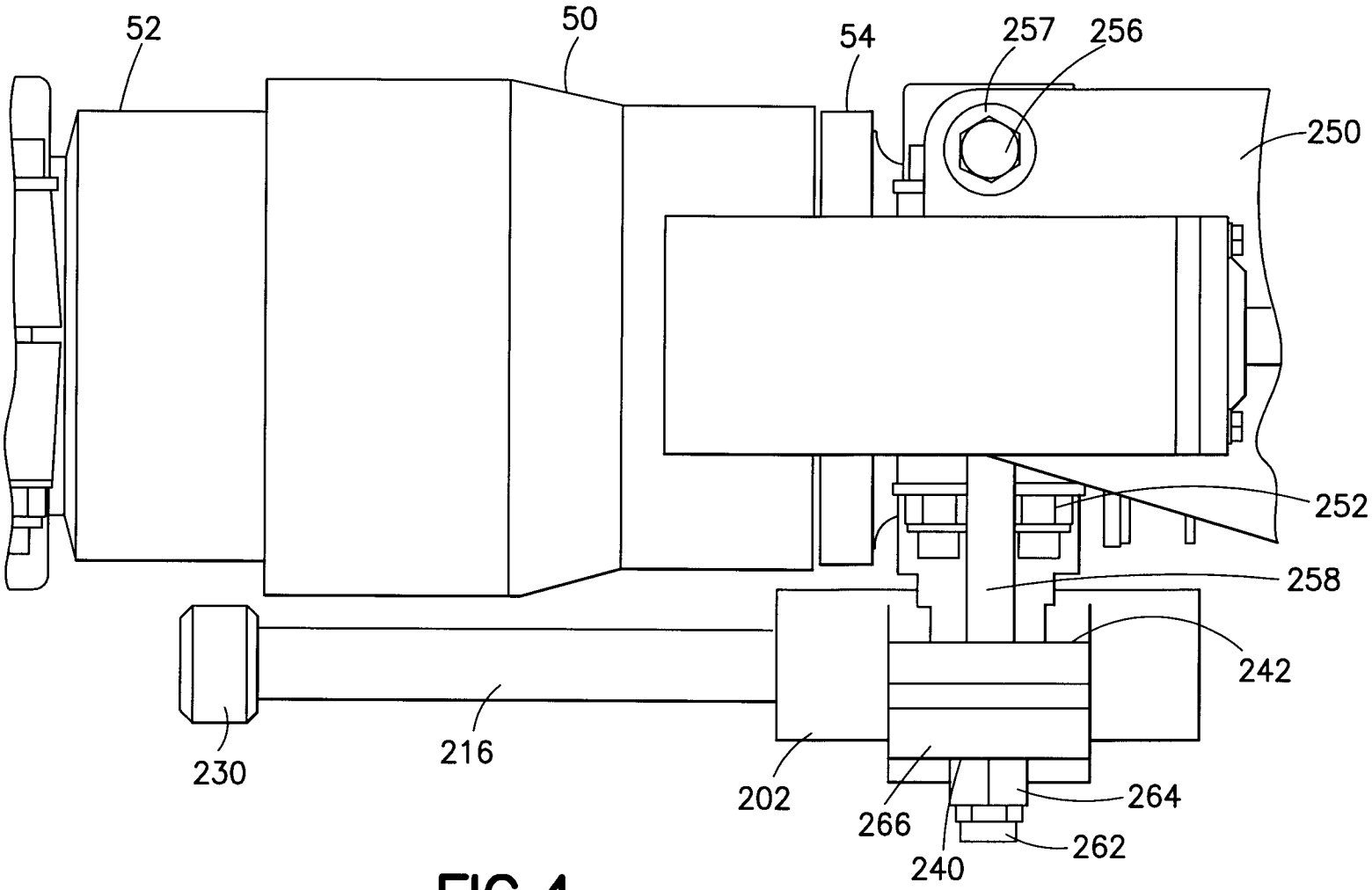
FIG. 4 is a side view of the coupler support mechanism installed on a transit car coupler as shown in FIGS. 2-3.
Figure 5:
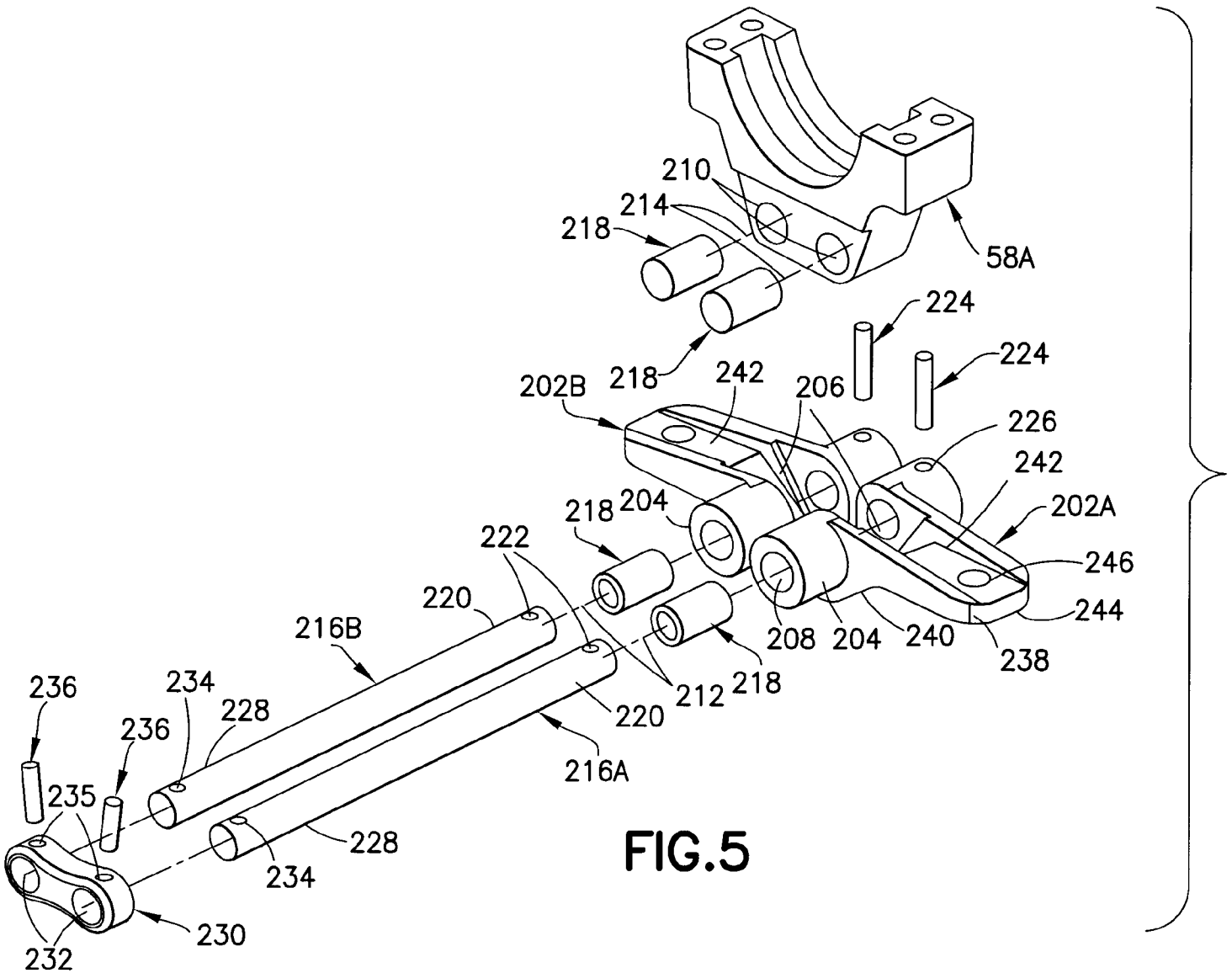
FIG. 5 is an exploded perspective view of the coupler support mechanism shown in FIGS. 2-4.
Figure 6:
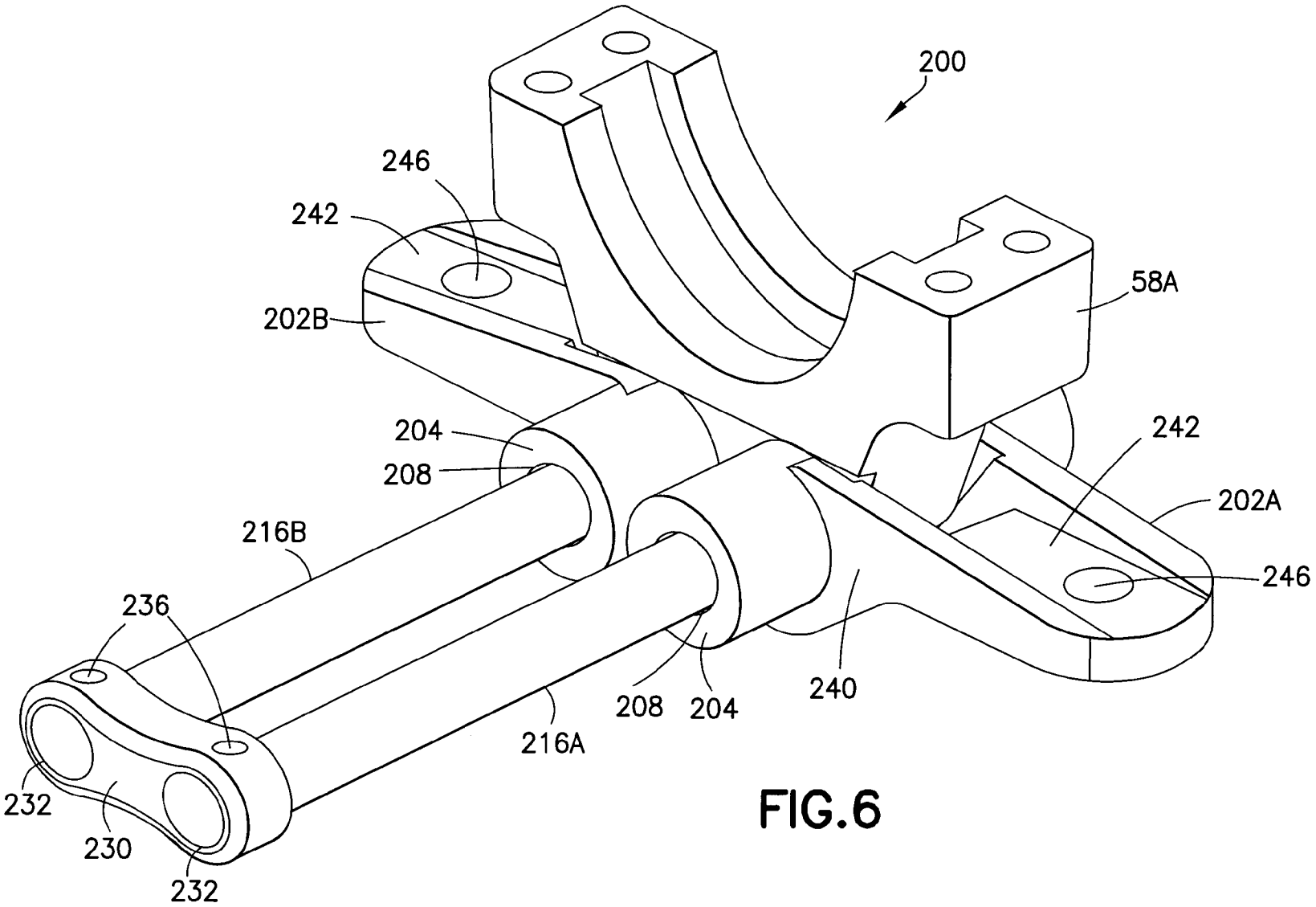
FIG. 6 is a front perspective view of the coupler support mechanism shown in FIGS. 2-4.
Figure 7:
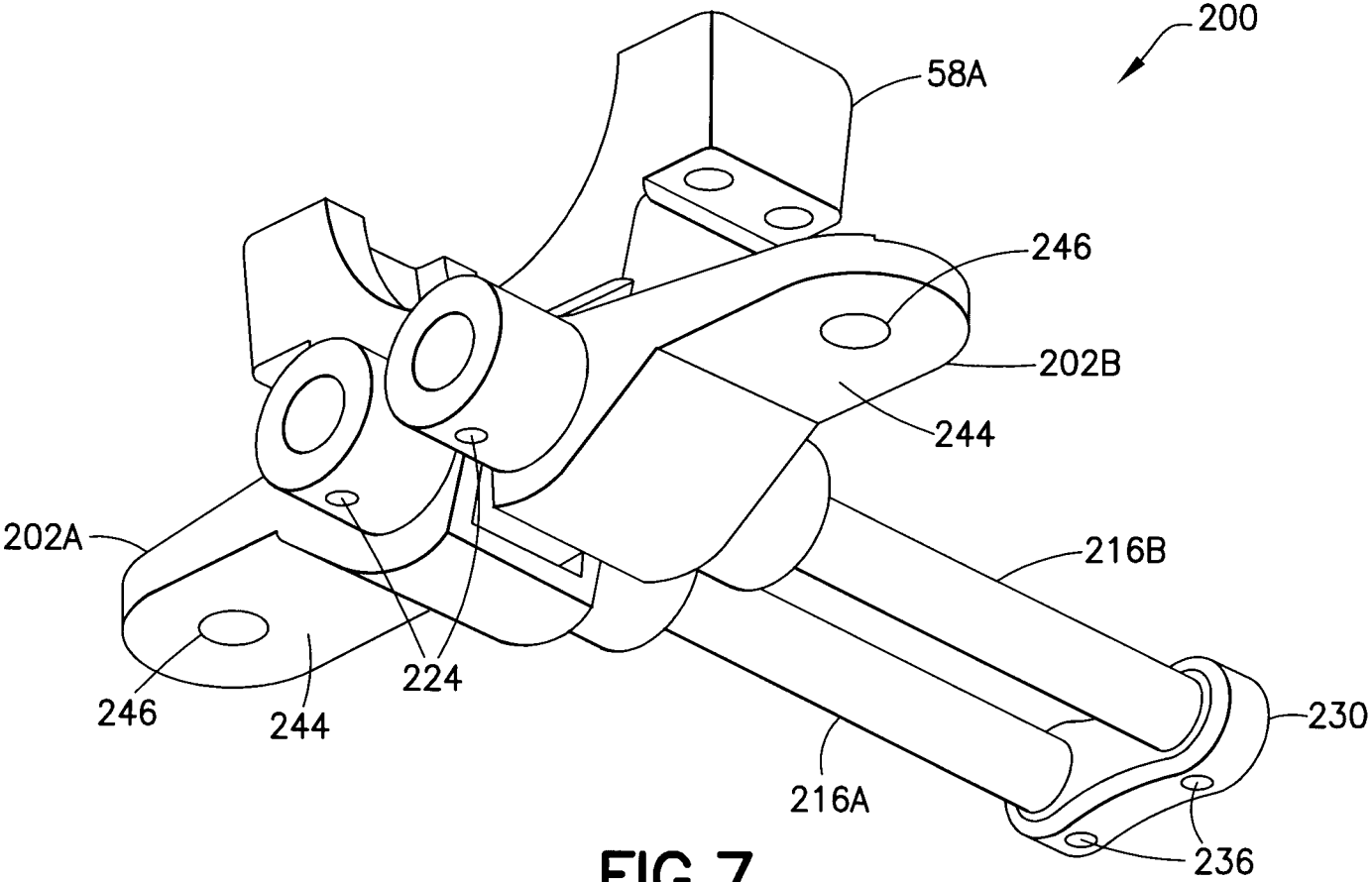
FIG. 7 is a bottom perspective view of the coupler support mechanism shown in FIGS. 2-4.
Figure 8:
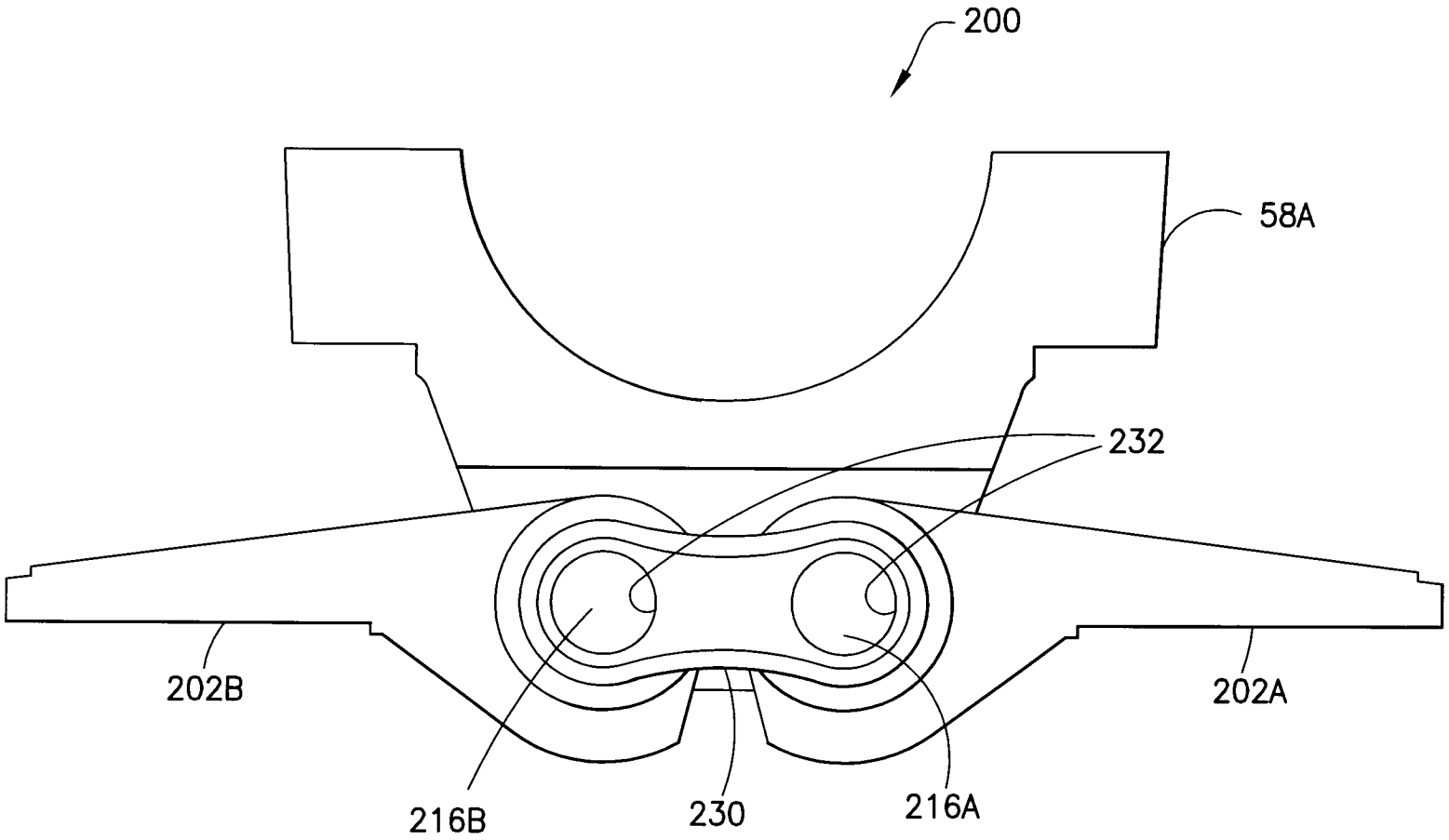
FIG. 8 is a front view of the coupler support mechanism shown in FIGS. 2-4.
Figure 9:
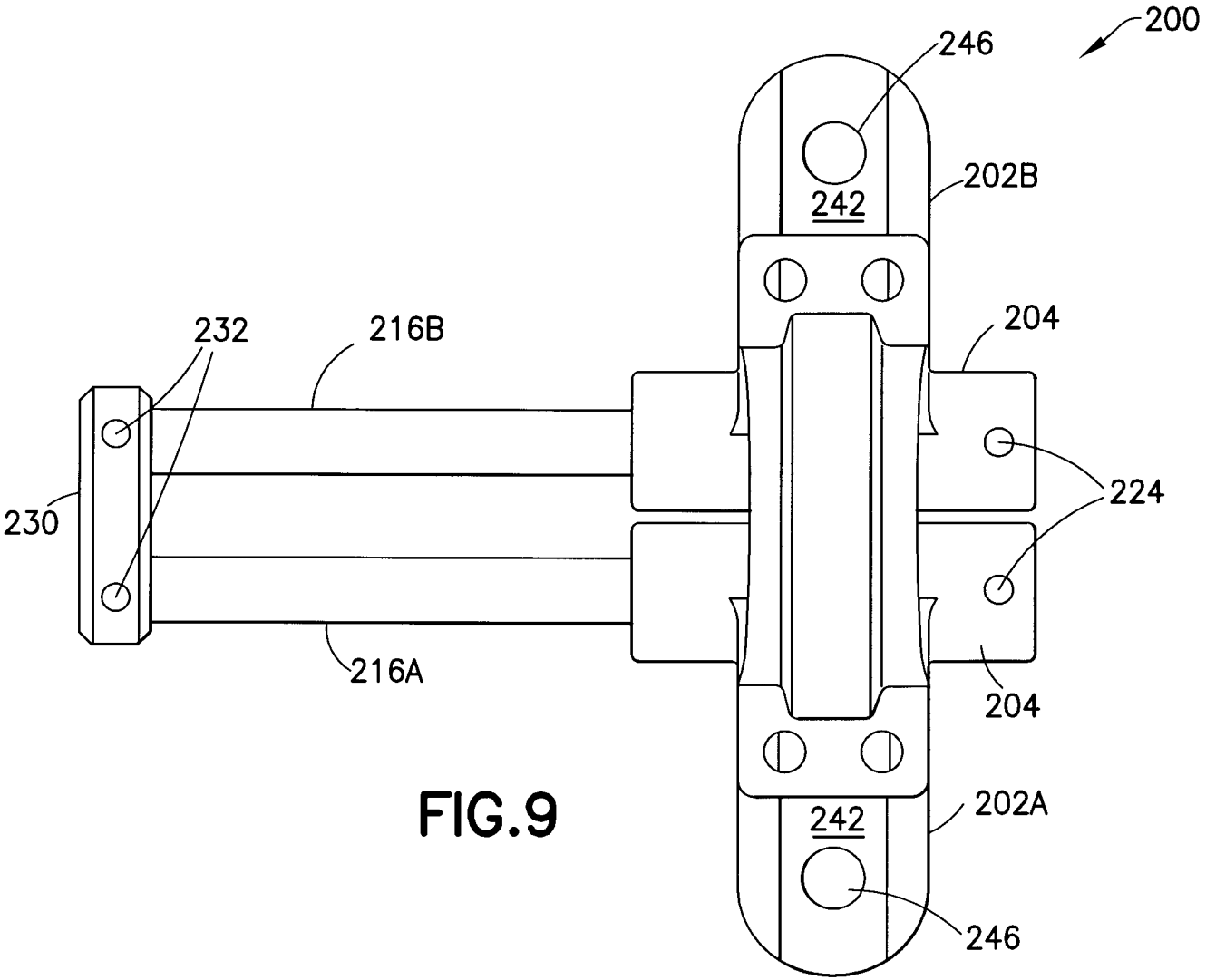
FIG. 9 is a top view of the coupler support mechanism shown in FIGS. 2-4.
Figure 10:
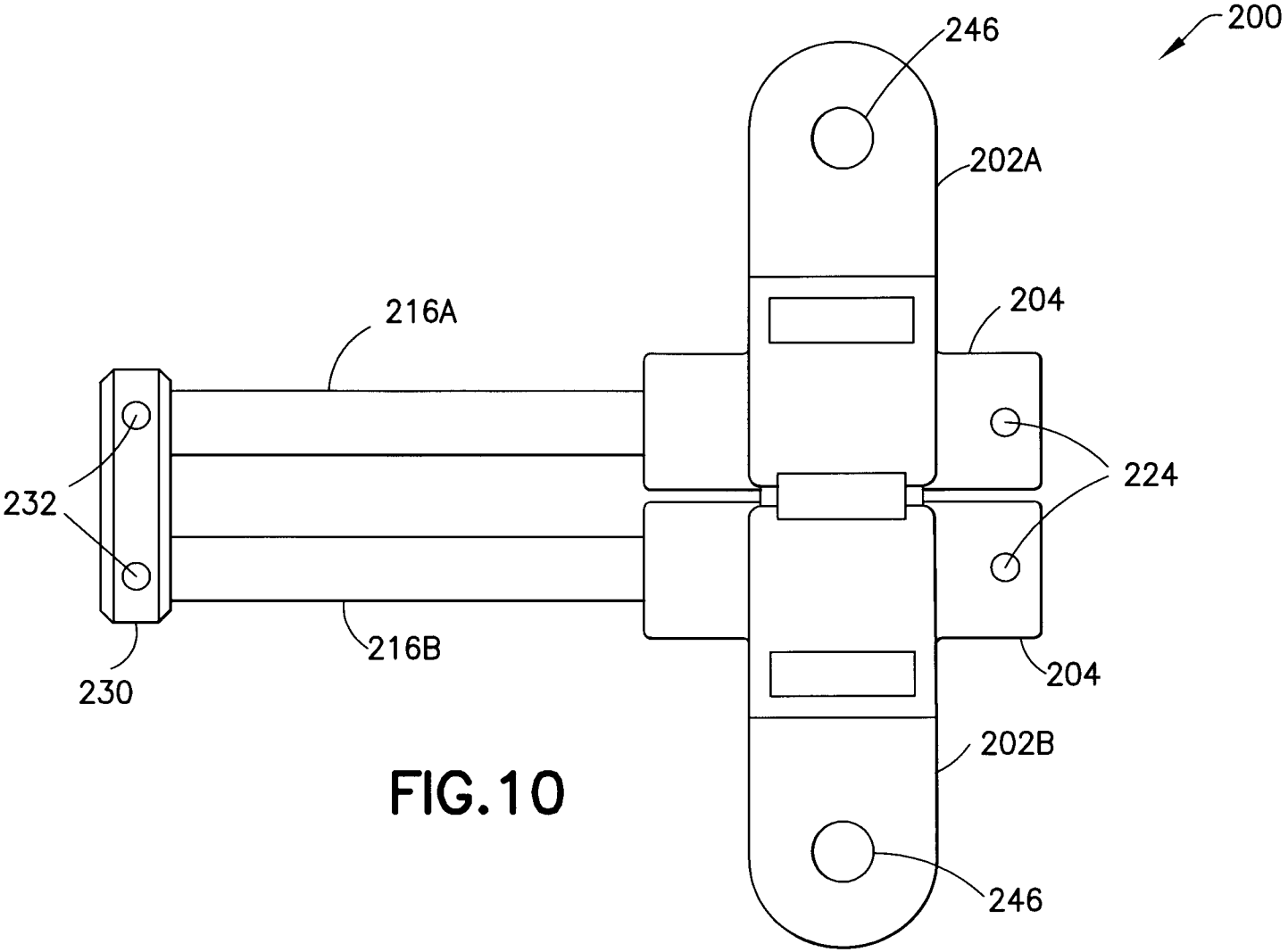
FIG. 10 is a bottom view of the coupler support mechanism shown in FIGS. 2-4.
Figure 11:
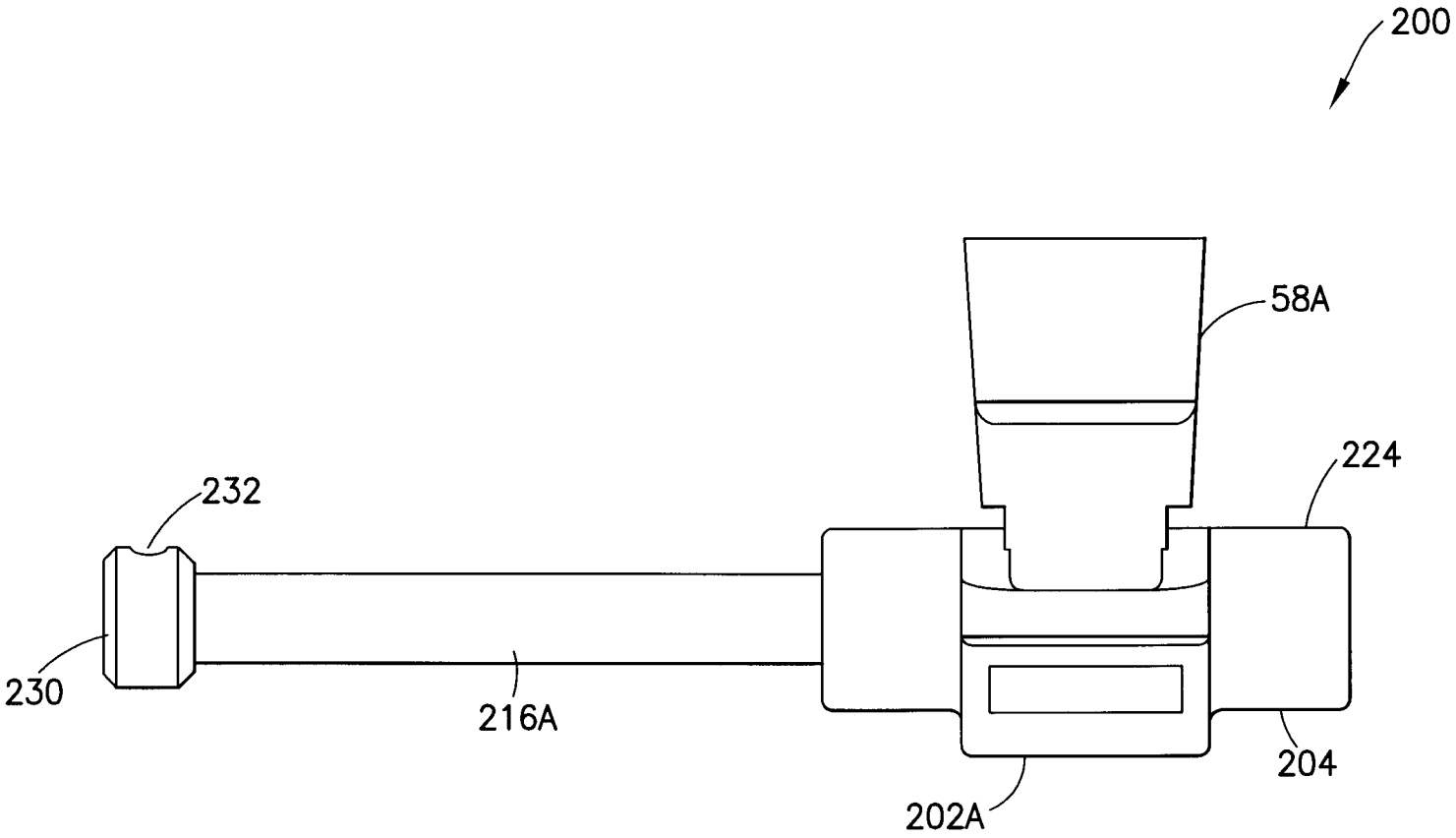
FIG. 11 is a side view of the coupler support mechanism shown in FIGS. 2-4.

With reference to FIGS. 2-11 and particular reference to FIG. 5, an embodiment of a coupler 10 having a coupler support mechanism 200 in accordance with one embodiment is shown. Coupler support mechanism 200 includes a left support arm 202A and a right support arm 202B pivotally engaged to a lower part 58A of second coupling connector 58. Each of left support arm 202A and right support arm 202B includes a support arm mounting element 204 having a recessed central portion 206 and an opening 208 extending through mounting element 204 in the longitudinal direction. Left support arm 202A and right support arm 202B cradle lower part 58A of second coupling connector 58 when recessed central portion 206 of mounting element 204 of each support arm is inserted around lower part 58A of second coupling connector 58. Corresponding openings 210 are provided on lower part of 58A of second coupling connector 58 such that a central axis 212 of openings 208 on left support arm 202A and right support arm 202B aligns with a central axis 214 of openings 210 on lower part 58A when mounting element 204 of each support arm is engaged around lower part 58A. A left torsion spring 216A and a right torsion spring 216B are inserted through openings 208 of each mounting element 204 of left support arm 202A and right support arm 202B, respectively.

In an installed state, left and right torsion springs 216A, 216B, also pass through openings 210 in lower part 58A of second coupling connector 58. Bushings 218 are provided inside openings 208 on mounting element 204 and openings 210 on lower part 58A to facilitate rotational movement of each torsion spring inside its respective opening. A first end 220 of left torsion spring 216A and right torsion spring 216B includes a hole 222 which accepts a first pin 224. First pin 224 is utilized to secure the first end of each torsion spring with respect to the corresponding support arm. Each mounting element 204 includes a first hole 226 through which first pin 224 may be inserted. In an installed state, each first pin 224 prevents the longitudinal movement as well as rotation of first end 220 of left torsion spring 216A and right torsion spring 216B with respect to left support arm 202A and right support arm 202B, respectively.

A second end 228 of each torsion spring is secured inside a torsion spring connector 230. Torsion spring connector 230 includes left and right openings 232 through which corresponding second ends 228 of left torsion spring 216A and right torsion spring 216B are inserted. Each second end 228 includes a second hole 234 through which a second pin 236 is inserted. Similarly, torsion spring connector 230 also includes corresponding openings 235 to accept second pins 236. In an installed state, each second pin 236 prevents the longitudinal movement as well as rotation of second end 228 of left torsion spring 216A and right torsion spring 216B with respect to torsion spring connector 230.

Left support arm 202A and right support arm 202B each include an arm element 238 extending outward from mounting element 204. Each arm element 238 includes a flanged portion 240 monolithically formed with mounting element 204. Similar to mounting elements 204, each arm element 238 is recessed in its central part to allow the mounting of support arms to lower part 58A of second coupling connector 58. Each arm element 238 has an upper face 242 and a lower face 244. A hole 246 is provided at the distal end of each arm element 238 such that hole 246 extends through arm element 238 between upper face 242 and lower face 244. FIGS. 6-11 illustrate coupler support mechanism 200 in an assembled state coupled to lower part 58A of second coupling connector 58.

Figure 2:
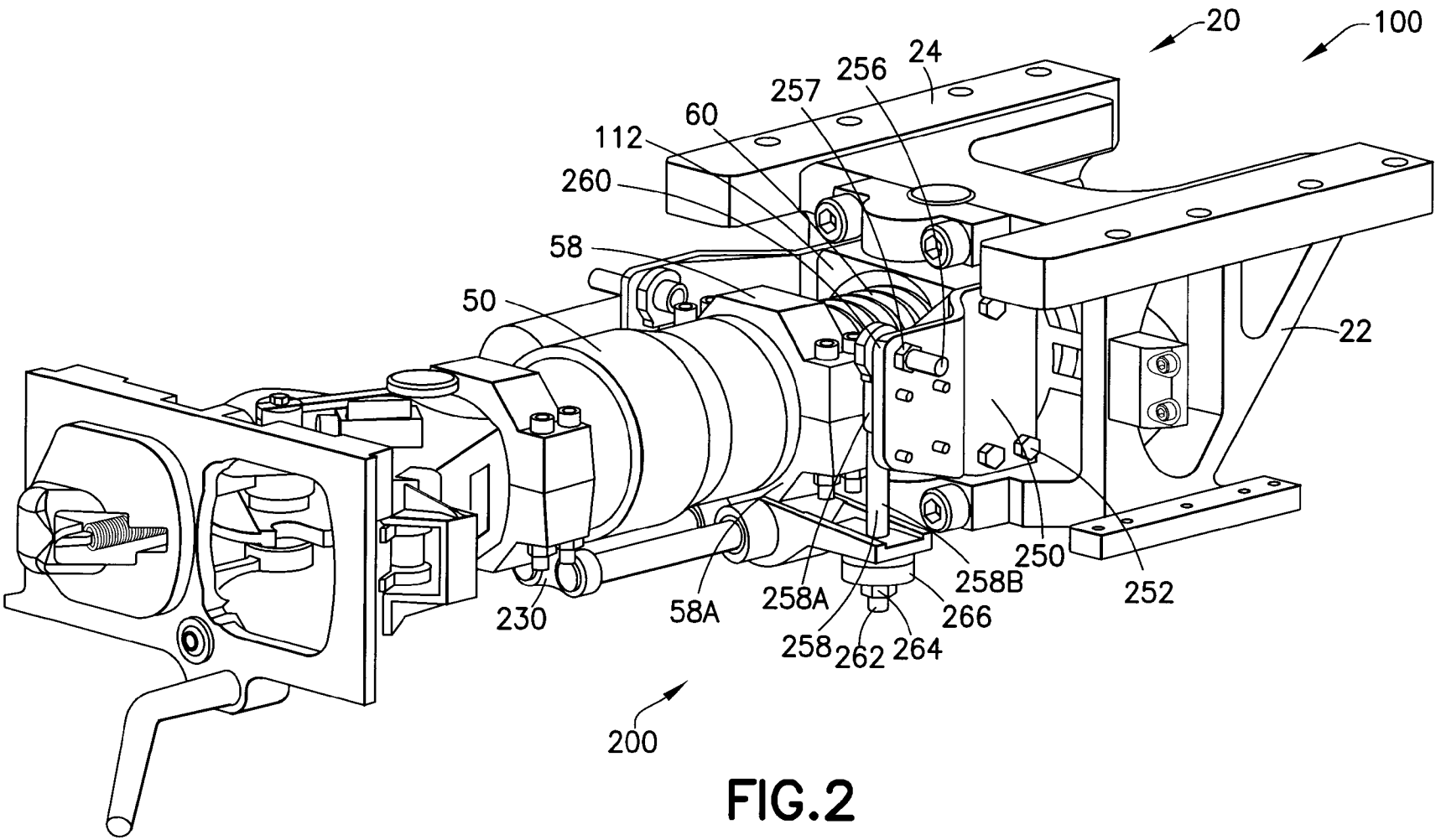
FIG. 2 is a top perspective view of an embodiment of a coupler support mechanism installed on a transit car coupler according to one embodiment.

With reference to FIGS. 2-4, the coupler support mechanism 200 is shown installed on coupler 10. Coupler support mechanism 200 is connected to lower part 58A of second coupling connector 58 by inserting left torsion spring 216A and right torsion spring 216B through respective openings 208 and 210 provided on left support arm 202A, right support arm 202B, and lower part 58A. Lower part 58A is coupled to upper part of second coupling connector 58 by a plurality of bolts 248, or like fastening elements.

A support bracket 250 is coupled to slide anchor assembly 112 by one or more fasteners 252. Support bracket 250 includes a through hole for supporting a pin or bolt 256 engaging a tension rod 258 to control the vertical displacement of coupler support mechanism 200 at a specified level with respect to the ground. Tension rod 258 includes an upper part 258A and a lower part 258B threadably engaged to each other. Length of tension rod 258 is adjustable by rotating upper part 258A with respect to lower part 258B. Upper part 258A includes a hole 260 through which bolt 256 is inserted and secured by a nut 257 to couple tension rod 258 to support bracket 250. Lower part 258B of tension rod 258 has a threaded end 262 for engaging a nut 264. One support bracket 250 and a corresponding tension rod 258 are provided on each lateral side of slide anchor assembly 112. Each support bracket 250 and corresponding tension rod 258 are desirably oriented in a symmetrical arrangement with respect to slide anchor assembly 112.

Lower part 258B of each tension rod 258 engages a corresponding support arm of coupler support mechanism 200. A hole 246 in each arm element 238 of left support arm 202A and right support arm 202B is dimensioned such that lower part 258B of each tension rod 258 may freely pass through each hole 246 without interfering with the sidewall of hole 246. A spherical bearing 266 is provided on an upper face 242 of arm element 238 of each support arm 202. Lower part 258B of each tension rod 258 passes through each spherical bearing 266 and is secured to each support arm 202 by threadably engaging nut 264 to threaded end 262 of lower part 258B of each tension rod 258. Spherical bearings 266 are provided to assure a constant connection between each tension rod 258 and lower face 244 of each arm element 238 during the pivoting motion of each support arm. By adjusting the length of each tension rod 258, the orientation of the corresponding support arm 202 changes with respect to lower part 58A of second coupling connector 58. Shortening each tension rod 258 causes arm element 238 of the corresponding support arm 202 to pivot upward with respect to the ground. Conversely, lengthening each tension rod 258 causes arm element 238 of the corresponding support arm 202 to pivot in a downward direction with respect to the ground. Because the first and second ends 220 and 228, respectively, of each torsion spring 216 are fixed with respect to mounting element 204 of each support arm 202 and torsion spring connector 230, the pivoting movement of arm elements 238 of each support arm causes each torsion spring to twist in response.

Figure 12:
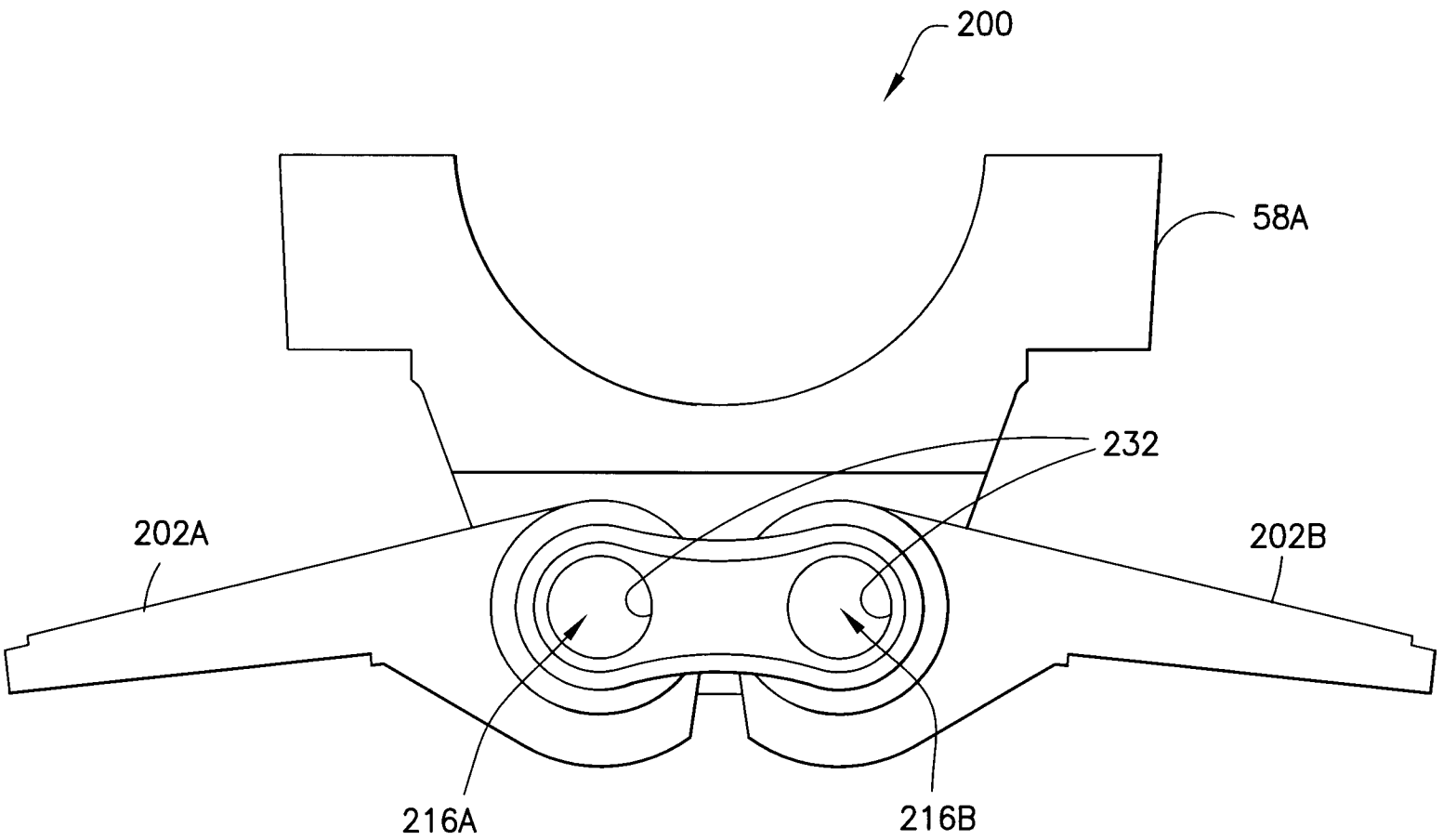
FIG. 12 is a rear view of the coupler support mechanism shown in FIGS. 2-4 in an unloaded state.
Figure 13:
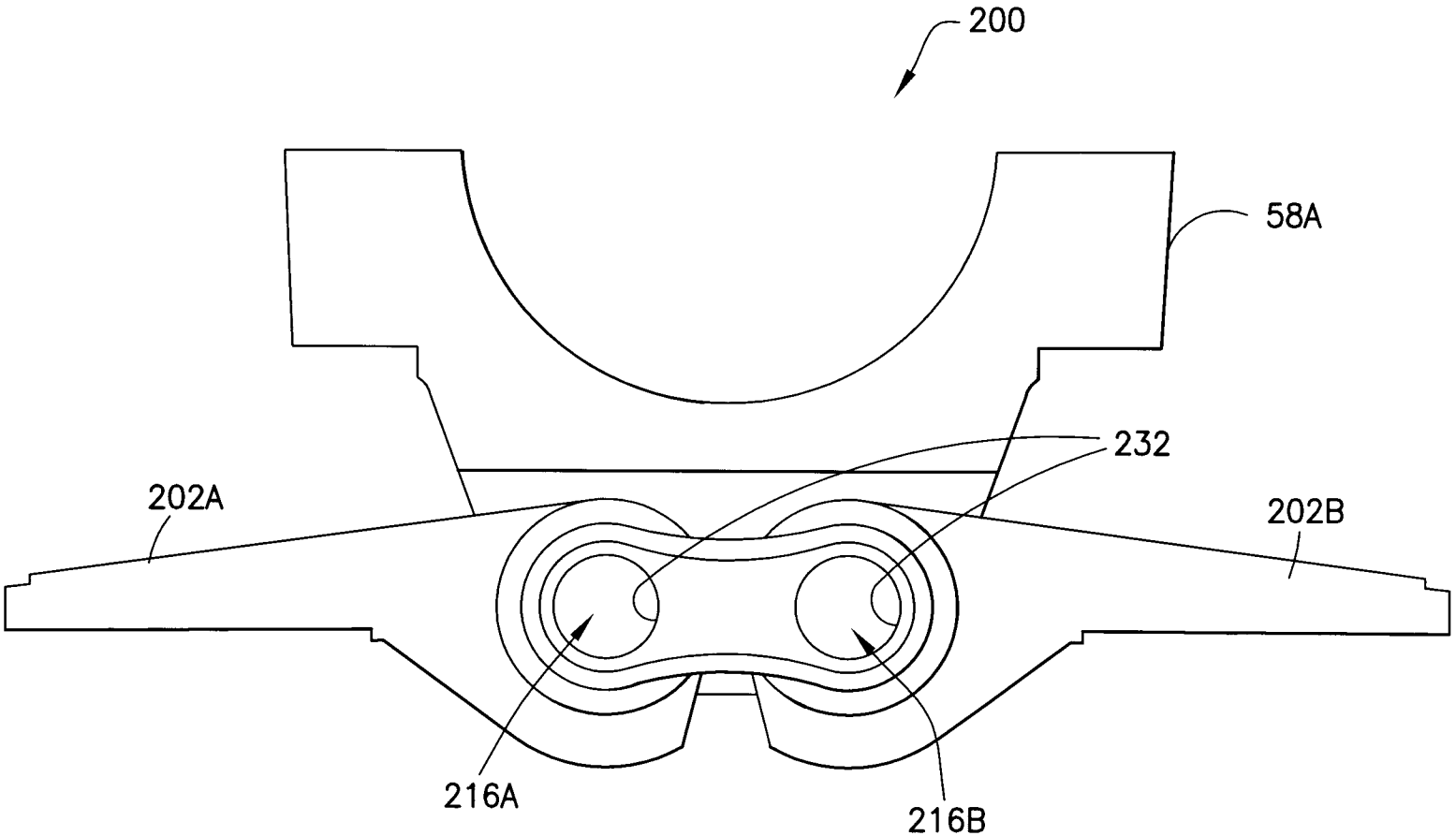
FIG. 13 is a rear view of the coupler support mechanism shown in FIGS. 2-4 in a default state when installed on a transit car coupler.
Figure 14:
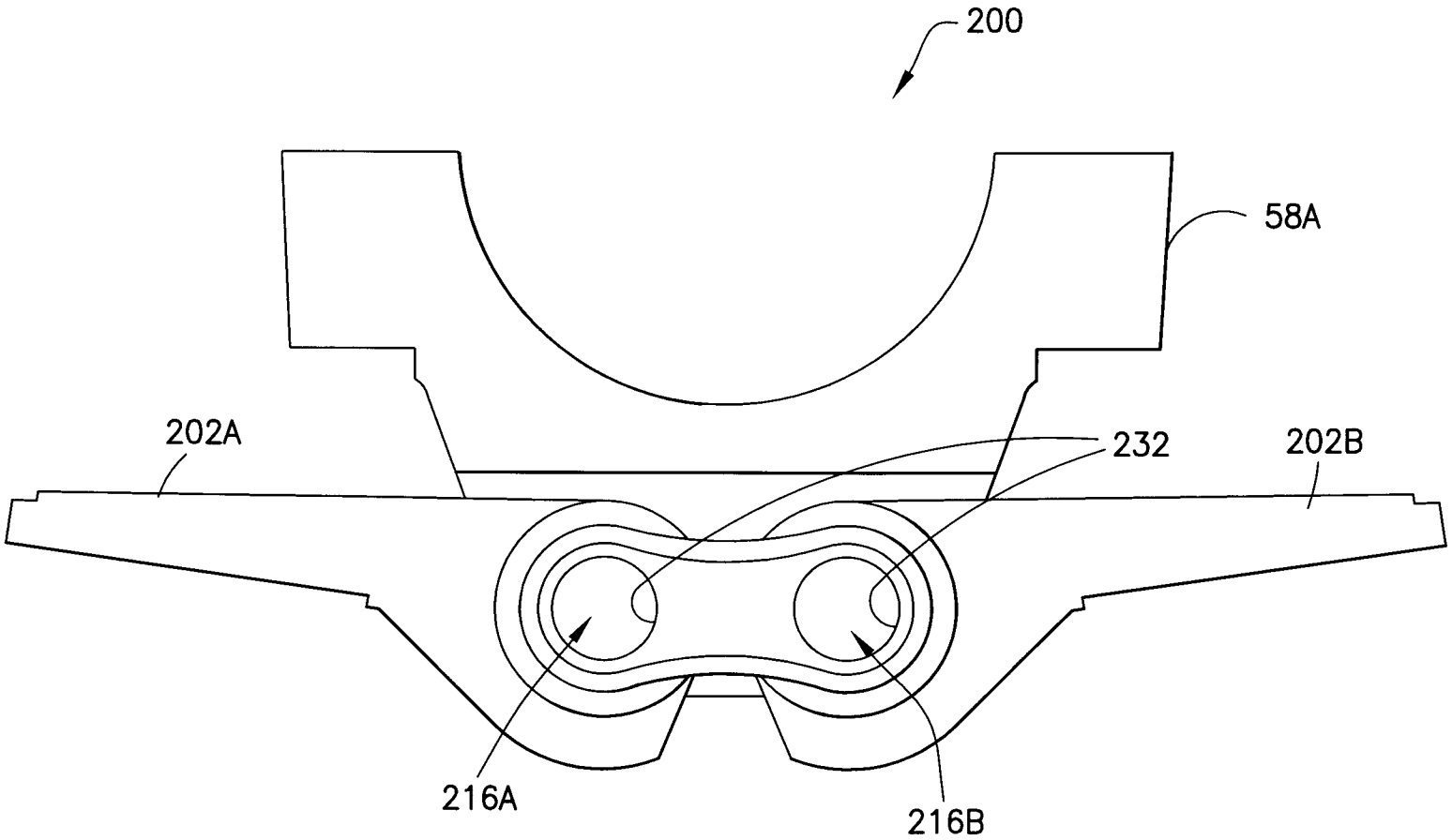
FIG. 14 is a rear view of the coupler support mechanism shown in FIGS. 2-4 in a maximum tension state due to a vertical load placed on a transit car coupler.

With reference to FIGS. 12-14, coupler support mechanism 200 is shown in various states of loading. FIG. 12 illustrates coupler support mechanism 200 in a first, unloaded state. In this configuration, left torsion spring 216A and right torsion spring 216B are in their unloaded states such that first end 220 and second end 228 of each torsion spring are not rotated with respect to each other. As shown in FIG. 12, each support arm 202 is oriented in a slight downward direction.

In a second configuration, illustrated in FIG. 13, coupler support mechanism 200 is shown in a second, default state when installed on a coupler head of a transit car (not shown). In this configuration, each support arm 202 is rotated in an upward direction such that arm elements 238 are substantially parallel to the ground. Because each arm 202 is rotated with respect to lower part 58A of second coupling connector 58, the first end 220 and second end 228 of left torsion spring 216A and right torsion spring 216B are rotated with respect to each other. Such motion causes each torsion spring 216 to become loaded while supporting the load imposed by the coupler head.

In a third configuration, illustrated in FIG. 14, coupler support mechanism 200 is shown in a third, loaded state, wherein coupler support mechanism 200 is subjected to a higher load than in a default state shown in FIG. 13, and, thus, the support arms 202 are nearly parallel to the ground. In the configuration shown in FIG. 14, each support arm 202 is rotated in an upward direction such that arm elements 238 are deflected toward lower part 58A of second coupling connector 58. Similar to the default configuration shown in FIG. 13, because each arm is rotated with respect to lower part 58A of second coupling connector 58, the first end 220 and second end 228 of left torsion spring 216A and right torsion spring 216B are rotated with respect to each other. Such motion causes each torsion spring 216 to become loaded while supporting the load imposed by the coupler head. In this configuration, each torsion spring is loaded to a higher extent compared to the default configuration. Vertical deflection of each support arm 202 is dependent on the stiffness of torsion spring 216, which is a function of material properties of each torsion spring 216, as well the length and diameter of each torsion spring 216.

While FIGS. 12-14 illustrate embodiments in which both support arms are pivoted to the same extent in a symmetrical manner, left support arm 202A may be pivoted independently of right support arm 202B, and vice versa. Such adjustment allows for lateral movement of coupler support mechanism 200 about the longitudinal axis. By moving left support arm 202A independently of right support arm 702R, left torsion spring 216A is loaded to a different extent compared to right torsion spring 216B. This allows coupler support mechanism 200 to support loads which are not evenly distributed on the coupler head. Additionally, by independently moving left support arm 202A with respect to right support arm 202B, alignment of coupler 10 of one car can be fine tuned with respect to coupler 10 of an adjacent car. Furthermore, independent pivoting motion of left support arm 202A with respect to right support arm 202B allows coupler 10 to move in at least the longitudinal and lateral planes of the cars during coupling and/or motion of the cars.

One benefit of coupler 10 incorporating coupler support mechanism 200 over the previously described vertical support mechanism 138 is that coupler support mechanism 200 enables motion of coupler 10 in more than one plane that may not necessarily be parallel to the ground, whereas vertical support mechanism 138 only allows for adjustment in one plane that is parallel to the ground. Coupler support mechanism 200 allows fine tuning of the alignment of coupler 10 of one car with a corresponding coupler 10 of an adjacent car. Another benefit is that the use of torsion springs 216 allows for a more compact and lightweight installation which allows additional space for auxiliary equipment, whereas in vertical support mechanism 138, springs 144 take up substantially more room underneath coupler 10. Thus, coupler support mechanism 200 may be used to replace vertical support mechanism 138 of the prior art in order to provide additional adjustment to alignment of coupler 10 as well as to provide additional space adjacent to coupler 10 for installation of other equipment. It may be desirable in certain applications to eliminate the use of a deformation tube 50 and reduce the overall length of the coupler 10. However, coupler 10 including a deformation tube 50, as described in the foregoing description, provides enhanced energy absorption characteristics.

While embodiments of a coupler 10 for railway and like vehicles and methods of assembly and operation thereof were provided in the foregoing description, those skilled in the art may make modifications and alterations to these embodiments without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A coupler for a railway car, comprising:

a coupler anchor;

a coupler mechanism connected to the coupler anchor; and a coupler support mechanism supporting the coupler mechanism vertically, the coupler support mechanism comprising:

a plurality of support arms connected to the coupler anchor for supporting a railway car coupler; and a plurality of torsion springs corresponding to the plurality of support arms, wherein the plurality of torsion springs is operatively connected to the plurality of support arms such that pivotal movement of any of the plurality of support arms in a vertical direction causes a rotational movement of the corresponding torsion springs.

2. The coupler of claim 1, wherein each of the plurality of support arms is pivotally movable independent of the remaining support arms to allow for movement of the coupler anchor in at least two planes of motion.

3. The coupler of claim 1, further comprising a plurality of tension rods corresponding to the plurality of support arms, wherein the plurality of tension rods is operatively connected to the support arms to control the pivotal movement of the support arms.

4. The coupler of claim 3, wherein a first end of each of the plurality of tension rods is connected to the coupler anchor and a second end of each of the plurality of tension rods is connected to the corresponding support arm.

5. The coupler of claim 1, wherein each of the plurality of support arms includes a support arm mounting element having a recessed central portion and an opening extending through the support arm mounting element.

6. The coupler of claim 5, wherein each of the plurality of support arms further includes an arm element extending from the mounting element, wherein the corresponding tension rod is operatively connected to the arm element.

7. The coupler of claim 1, wherein a first end of each of the plurality of torsion springs is connected to the corresponding support arm and wherein a second end of each of the plurality of torsion springs is connected to a torsion spring connector.

8. A coupler for a railway car, comprising:

a coupler anchor;

a coupler mechanism connected to the coupler anchor; and a coupler support mechanism supporting the coupler mechanism, the coupler support mechanism comprising:

a plurality of support arms connected to the coupler anchor for supporting a railway car coupler;

a plurality of torsion springs corresponding to the plurality of support arms; and a plurality of tension rods corresponding to the plurality of support arms;

wherein the plurality of torsion springs is operatively connected to the plurality of support arms such that pivotal movement of any of the plurality of support arms causes a rotational movement of the corresponding torsion springs, wherein the plurality of tension rods is operatively connected to the support arms to control the pivotal movement of the support arms, and wherein the length of each of the plurality of tension rods is adjustable such that each of the corresponding torsion springs is loaded when the tension rod is shortened and unloaded when the tension rod is lengthened.

9. The coupler of claim 8, wherein the length of each of the plurality of tension rods is adjustable by rotating an upper end of the tension rod with respect to the lower end of the tension rod.

10. A railway car coupler for coupling railway cars, the railway car coupler comprising:

a coupler anchor connected to a railway car body;

a coupler mechanism connected to the coupler anchor by a deformation tube; and a coupler support mechanism supporting the coupler mechanism vertically, comprising:

a plurality of support arms connected to the coupler anchor for supporting a railway car coupler; and a plurality of torsion springs corresponding to the plurality of support arms, wherein the plurality of torsion springs is operatively connected to the plurality of support arms such that pivotal movement of any of the plurality of support arms in a vertical direction causes a rotational movement of the corresponding torsion springs.

11. The railway car coupler of claim 10, wherein each of the plurality of support arms is pivotally movable independent of the remaining support arms to allow for movement of the coupler anchor in at least two planes of motion.

12. The railway car coupler of claim 10, further comprising a plurality of tension rods corresponding to the plurality of support arms, wherein the plurality of tension rods is operatively connected to the support arms to control the pivotal movement of the support arms.

13. The railway car coupler of claim 12, wherein a first end of each of the plurality of tension rods is connected to the coupler anchor and a second end of each of the plurality of tension rods is connected to the corresponding support arm.

14. The railway car coupler of claim 10, wherein each of the plurality of support arms includes a support arm mounting element having a recessed central portion and an opening extending through the support arm mounting element.

15. The railway car coupler of claim 14, wherein each of the plurality of support arms further includes an arm element extending from the mounting element, wherein the corresponding tension rod is operatively connected to the arm element.

16. A railway car coupler for coupling railway cars, the railway car coupler comprising:

a coupler anchor connected to a railway car body;

a coupler mechanism connected to the coupler anchor by a deformation tube; and a coupler support mechanism supporting the coupler mechanism, comprising:

a plurality of support arms connected to the coupler anchor for supporting a railway car coupler;

a plurality of torsion springs corresponding to the plurality of support arms; and a plurality of tension rods corresponding to the plurality of support arms, wherein the plurality of torsion springs is operatively connected to the plurality of support arms such that pivotal movement of any of the plurality of support arms causes a rotational movement of the corresponding torsion springs, wherein the plurality of tension rods is operatively connected to the support arms to control the pivotal movement of the support arms, and wherein the length of each of the plurality of tension rods is adjustable such that each of the corresponding torsion springs is loaded when the tension rod is shortened and unloaded when the tension rod is lengthened.

17. The railway car coupler of claim 16, wherein the length of each of the plurality of tension rods is adjustable by rotating an upper end of the tension rod with respect to the lower end of the tension rod.

18. A coupler support mechanism for a railway car coupler comprising a coupler anchor and a coupler mechanism connected to the coupler anchor, the coupler support mechanism comprising:

a plurality of support arms connected to the coupler anchor for supporting a railway car coupler; and a plurality of torsion springs corresponding to the plurality of support arms, wherein the plurality of torsion springs is operatively connected to the plurality of support arms such that pivotal movement of any of the plurality of support arms in a vertical direction causes a rotational movement of the corresponding torsion springs, and wherein the coupler support mechanism is positioned to support the coupler mechanism vertically.

19. The coupler support mechanism of claim 18, further comprising a plurality of tension rods corresponding to the plurality of support arms, wherein the plurality of tension rods is operatively connected to the support arms to control the pivotal movement of the support arms.

20. The coupler support mechanism of claim 19, wherein a first end of each of the plurality of tension rods is connected to the coupler anchor and a second end of each of the plurality of tension rods is connected to the corresponding support arm.

* * * * *